US008512056B2

(12) United States Patent
Wen et al.

(10) Patent No.: US 8,512,056 B2
(45) Date of Patent: Aug. 20, 2013

(54) ROTATABLE PLUG AND ELECTRONIC DEVICE HAVING SUCH ROTATABLE PLUG

(75) Inventors: Ping-Hung Wen, Taoyuan Hsien (TW); Chun-Chen Chen, Taoyuan Hsien (TW)

(73) Assignee: Delta Electronics, Inc., Taoyuan Hsien ( * ) Notice: Subject to any disclaimer, the term of this patent is extended or adjusted under 35 U.S.C. 154(b) by 182 days.

(21) Appl. No.: 13/179,845

(22) Filed: Jul. 11, 2011

(65) Prior Publication Data

US 2012/0021615 A1 Jan. 26, 2012

(30) Foreign Application Priority Data

Jul. 26, 2010 (TW) ..... 99124604 A

(51) Int. Cl.
*H01R 29/00* (2006.01)

(52) U.S. Cl.
USPC ..... 439/172

(58) Field of Classification Search
USPC ..... 439/13, 131, 166, 217, 218, 172, 439/173
See application file for complete search history.

(56) References Cited

U.S. PATENT DOCUMENTS 5,727,953 A * 3/1998 Pasholk ..... 439/21
6,364,716 B1 * 4/2002 Seo ..... 439/640
6,821,134 B2 * 11/2004 Chen ..... 439/131
6,824,296 B2 * 11/2004 Souza et al. ..... 362/282
6,893,297 B2 * 5/2005 Chen ..... 439/680
6,942,508 B2 * 9/2005 Wong ..... 439/171
7,118,399 B1 * 10/2006 Wen et al. ..... 439/166
7,168,968 B1 * 1/2007 Li ..... 439/172
7,168,969 B1 * 1/2007 Wang ..... 439/173
7,381,059 B2 * 6/2008 Wong ..... 439/22
7,462,074 B1 * 12/2008 Devlin et al. ..... 439/640
7,597,570 B2 * 10/2009 So ..... 439/172
7,632,119 B1 * 12/2009 Ma et al. ..... 439/172
7,845,951 B1 * 12/2010 Goon ..... 439/21
7,946,868 B1 * 5/2011 Chen ..... 439/173
8,002,554 B2 * 8/2011 Wadsworth ..... 439/18
8,096,817 B2 * 1/2012 Lee et al. ..... 439/104
8,197,267 B2 * 6/2012 Kuo ..... 439/131
8,210,853 B2 * 7/2012 Gerard ..... 439/13
2006/0068608 A1 * 3/2006 McFadden ..... 439/22

* cited by examiner

*Primary Examiner* — Neil Abrams
*Assistant Examiner* — Travis Chambers
(74) *Attorney, Agent, or Firm* — Kirton McConkie; Evan R. Witt

(57) ABSTRACT

An electronic device includes a plug and a main body. The plug includes a casing and a base. The casing has an opening. An extension part is formed on an inner surface of the casing. The base includes at least two conducting pieces. The main body includes a coupling member. The coupling member has a fixing structure and two pins. After the fixing structure is penetrated through the opening, the fixing structure is rotated to be moved along the extension part to a fixed location, so that plug and the main body are combined together and the two pins are respectively contacted with the conducting pieces.

14 Claims, 6 Drawing Sheets

ROTATABLE PLUG AND ELECTRONIC DEVICE HAVING SUCH ROTATABLE PLUG

FIELD OF THE INVENTION

The present invention relates to an electronic device, and more particularly to an electronic device with a rotatable plug.

BACKGROUND OF THE INVENTION

Power converters such as power adapters or chargers become indispensable electronic devices for many kinds of electrical apparatuses. For example, by means of the power adapters, the utility power may be rectified and then converted into DC power for supplying power-receiving devices such as notebook computers. Alternatively, by means of the chargers, the converted DC power may charge the rechargeable batteries of the power-receiving devices such as mobile phones or digital cameras.

Generally, the power converter includes a plug for plugging into a power socket to receive utility power. Since the international business is well developed and the leisure life quality is much valued nowadays, people frequently go abroad for business or travel. When they go abroad, they usually carry the portable electronic products such as notebooks, mobile phones and digital cameras. However, since there are various kinds of socket standards in the world, the power converter is usually connected with a connector having different forms of conducting terminals in order to comply with different socket standards.

Nowadays, most power converters are wall-mount power converters. The plug of the wall-mount power converter is protruded from the main body thereof. Since the plug is unable to be rotated, some drawbacks occur. For example, after the plug of the wall-mount power converter is inserted into a power socket of a wall or a power strip, the volume of the wall-mount power converter becomes hindrance from inserting the plug of other electronic device into an adjacent power socket. Under this circumstance, it is difficult to insert the plug into the power socket.

Take the UK regulations and US regulation for example. Since the power socket is a three-hole socket and the corresponding plug is a three-terminal plug, the volume of such a plug is bulky. After the plug is inserted into the power socket, a large layout space is occupied. Similarly, if the plug of the power converter is unable to be rotated, it is difficult to insert the plug into the power socket. Moreover, if the power adapter is not in the usage status, it is difficult to store the electronic device because of the bulky volume of the plug.

For obviating the drawbacks encountered from the prior art, there is a need of providing an electronic device with a rotatable plug.

SUMMARY OF THE INVENTION

The present invention provides an electronic device with a rotatable plug, so that the orientation of the plug is changeable according to the practical requirements. After the plug is inserted into a power socket, the space utilization is enhanced.

The present invention provides an electronic device with a rotatable and detachable plug, in which the conducting terminals of the plug are specially designed to comply with various plug regulations. As a consequence, the electronic device is more user-friendly and easily stored.

In accordance with an aspect of the present invention, there is provided an electronic device. The electronic device includes a plug and a main body. The plug includes a casing and a base. The casing has an opening. An extension part is formed on an inner surface of the casing. The base includes at least two conducting pieces. The main body includes a coupling member. The coupling member has a fixing structure and two pins. After the fixing structure is penetrated through the opening, the fixing structure is rotated to be moved along the extension part to a fixed location, so that the plug and the main body are combined together and the at least two pins are respectively contacted with the at least two conducting pieces.

In accordance with another aspect of the present invention, there is provided a rotatable plug of an electronic device. The electronic device includes a main body. The main body includes a coupling member with a fixing structure and at least two pins. The casing has an opening. An extension part is formed on an inner surface of the casing. The rotatable plug includes a positioning ring and a base. The positioning ring is sheathed around an outer periphery of the extension part. The base includes at least two conducting pieces. After the fixing structure is penetrated through the opening, the fixing structure is rotated to be moved along the extension part to a fixed location, so that the plug and the main body are combined together and the at least two pins are respectively contacted with the at least two conducting pieces.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
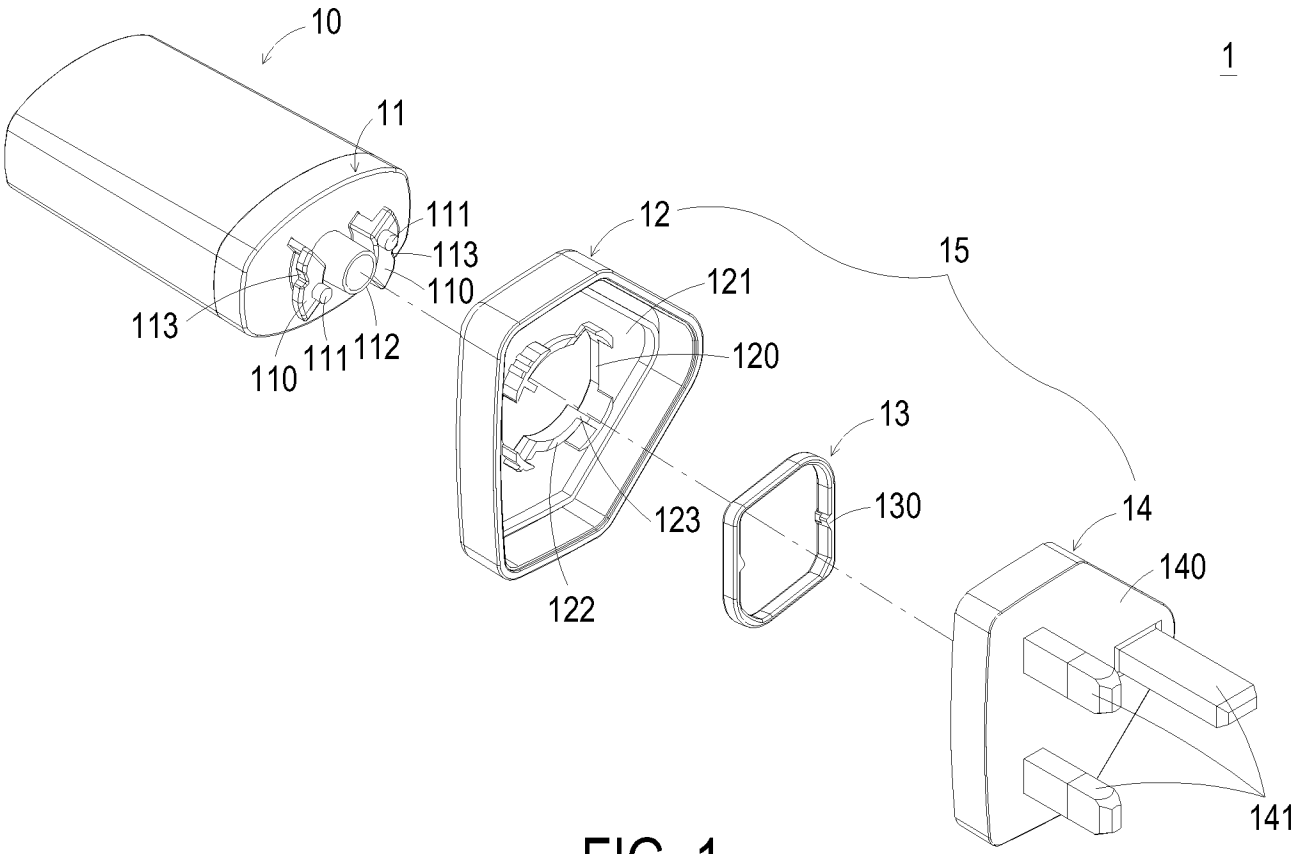
FIG. 1 is a schematic exploded view illustrating an electronic device with a rotatable plug according to an embodiment of the present invention.
Figure 2:
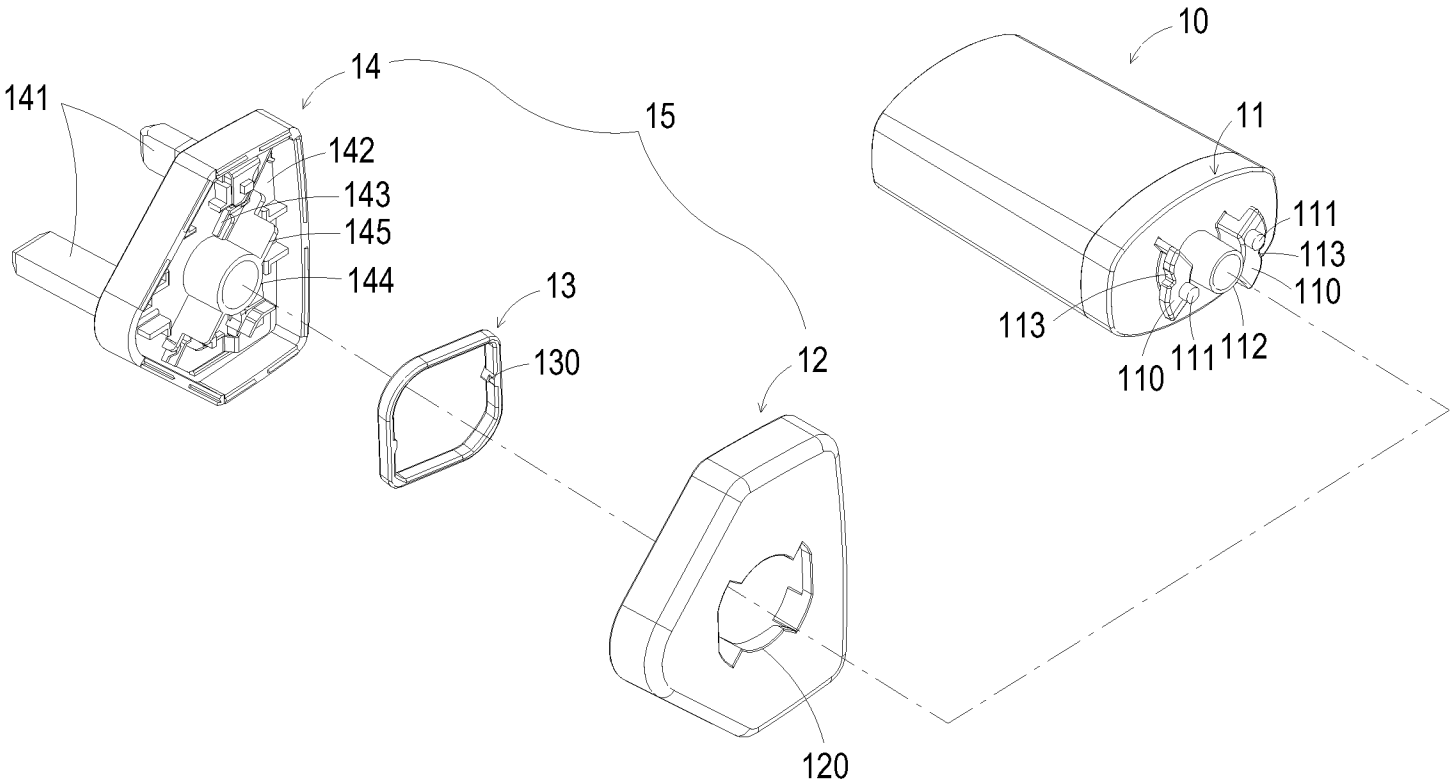
FIG. 2 is a schematic exploded view illustrating the electronic device of FIG. 1 and taken along another viewpoint.

FIG. 1 is a schematic exploded view illustrating an electronic device with a rotatable plug according to an embodiment of the present invention. FIG. 2 is a schematic exploded view illustrating the electronic device of FIG. 1 and taken along another viewpoint. As shown in FIGS. 1 and 2, the electronic device 1 includes a main body 10 and a plug 15. An example of the electronic device 1 includes but is not limited to a power converter, power adapter and charger. The plug 15 is detachably connected with the main body 10. The main body 10 has a coupling member 11. The coupling member 11 has two fixing structures 110 and two pins 111. The pins 111 are disposed beside the fixing structures 110. The plug 15 includes a casing 12, a positioning ring 13 and a base 14. The casing 12 has an opening 120. Moreover, two extension parts 122 and two stopping parts 123 are disposed on the inner surface 121 of the casing 12 and the periphery of the opening 120.

In this embodiment, the coupling member 11 is detachably connected with the main body 10. Alternatively, the coupling member 11 is integrally formed with the main body 10. In some embodiments, the coupling member 11 also has a central post 112. The fixing structure 110 of the coupling member 11 is an arc-shaped protruding structure. The arc-shaped profile of the fixing structure 110 mates with the profile of a corresponding inner periphery of the opening 120 of the casing 12, so that the fixing structure 110 can be penetrated through the opening 120 in a foolproof manner. In addition, the fixing structure 110 further includes a hooking part 113, which is arranged at the outer periphery of the arc-shaped profile of the fixing structure 110. In this embodiment, the hooking parts 113 are concave structures. In some embodiments, the two fixing structures 110 of the coupling member 11 may have different profiles. However, the profiles of the fixing structures 110 should mate with corresponding inner periphery of the opening 120 of the casing 12 so as to achieve a foolproof function.

Please refer to FIG. 1 again. The extension part 122 on the inner surface 121 of the casing 12 is arc-shaped and has a gradual slope. The gradual slope of the extension part 122 may guide movement of the corresponding fixing structures 110 of the main body 10. That is, after the fixing structures 110 of the main body 10 is penetrated through the opening 120, by rotating the fixing structures 110, the fixing structures 110 may be moved along the slopes of the extension parts 122. Moreover, the stopping part 123 is disposed at the distal end of the extension part 122. As the fixing structure 110 is moved along the arc-shaped extension part 122 and then sustained against the stopping part 123, the fixing structure 110 is stopped by the stopping part 123 from being continuously moved. Under this circumstance, the fixing structure 110 is fixed at the position corresponding to the stopping part 123.

In this embodiment, the positioning ring 13 is a quadrilateral ring-shaped structure for allowing the two fixing structures 110 to be rotated by 90 degrees. Alternatively, if the fixing structures 110 are designed to be rotated by different angles, the positioning ring 13 may have a different profile such as a hexagonal ring-shaped structure or an octagonal ring-shaped structure. Preferably, the positioning ring 13 is made of a plastic material with good elasticity and lubricity. The positioning ring 13 is disposed on the inner surface 121 of the casing 12 and sheathed around the outer peripheries of the extension part 122 and the stopping part 123. Moreover, the positioning ring 13 has two positioning points 130. In this embodiment, the positioning points 130 are convex structures corresponding to the hooking parts 113.

Figure 3:
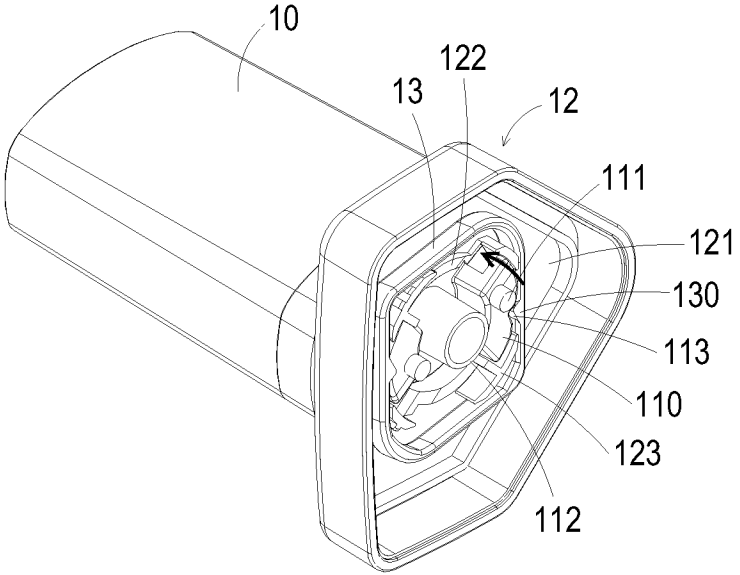
FIG. 3 is a schematic assembled view illustrating a combination of the main body and the casing and the positioning ring of the plug.

Hereinafter, a process of combining the main body 10 with the casing 12 and the positioning ring 13 of the plug 15 will be illustrated with reference to FIG. 3. Firstly, the fixing structures 110 are penetrated through the opening 120 of the casing 12. The hooking parts 113 of the fixing structures 110 are engaged with the positioning points 130, so that the fixing structures 110 are initially positioned. Then, by rotating the fixing structures 110, the fixing structures 110 are moved along the extension parts 122, so that the outer peripheries of the arc-shaped fixing structures 110 are sustained against the positioning ring 13 to prop open the positioning ring 13. Due to deformation of the positioning ring 13, the fixing structures 110 can be continuously moved along the slopes of the extension parts 122. Until the fixing structures 110 are rotated by a specified angle (e.g. 90 degrees), the fixing structures 110 are stopped from being moved by the stopping parts 123. Meanwhile, a corresponding positioning point 130 is sustained against an end of the fixing structure 110, thereby facilitating positioning the fixing structure 110. Under this circumstance, the main body 10 is rotated by 90 degrees, and thus the orientation of the plug 15 is changed.

Please refer to FIGS. 1 and 2 again. The base 14 of the plug 15 has an outer surface 140 and an inner surface 142. Three conducting terminals 141 are protruded from the outer surface 140 of the plug 15. Two conducting pieces 143 are formed on the inner surface 142 of the base 14 and connected with the conducting terminals 141. The conducting terminals 141 and the conducting pieces 143 are made of metallic material. In some embodiments, a hollow cylindrical structure 144 is formed on a middle of the inner surface 142 of the base 14, and two ribs 145 are extended from the hollow cylindrical structure 144. The hollow cylindrical structure 144 corresponds to the central post 112 of the coupling member 11. The two ribs 145 can be served as auxiliary stopping elements. For assembling the plug 15, the positioning ring 13 is firstly sheathed around the outer peripheries of the extension part 122 and the stopping part 123, and then the casing 12 is assembled with the base 14 so as to achieve the assembly of the plug 15.

Figure 4B:
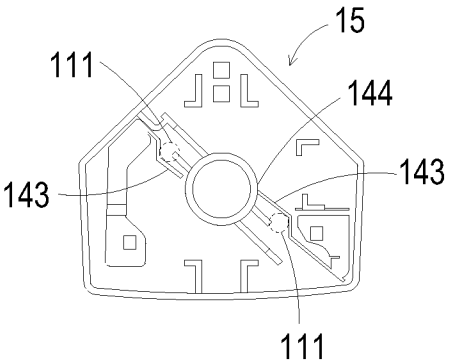
FIG. 4B schematically illustrates the relation between the main body of the electronic device and the rotatable plug, in which the pins of the coupling member and the conducting pieces are contacted with each other.
Figure 4A:
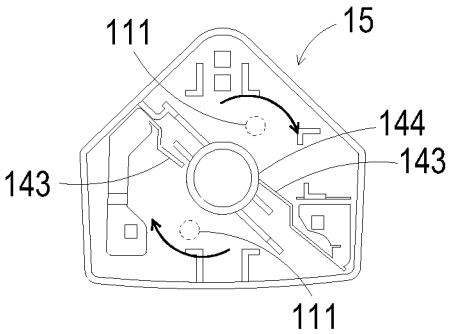
FIG. 4A schematically illustrates the relation between the main body of the electronic device and the rotatable plug, in which the pins of the coupling member and the conducting pieces are separated from each other.

FIG. 4A schematically illustrates the relation between the main body of the electronic device and the rotatable plug, in which the pins of the coupling member and the conducting pieces are separated from each other. After the fixing structure 110 of the coupling member 11 is penetrated through the opening 120 of the casing 12 of the plug 15, the pins 111 of the coupling member 11 are substantially perpendicular to adjacent conducting pieces 143 of the base 14. FIG. 4B schematically illustrates the relation between the main body of the electronic device and the rotatable plug, in which the pins of the coupling member and the conducting pieces are contacted with each other. By rotating the main body 10 of the electronic device 1 or rotating the plug 15, the fixing structure 110 is moved along the slope of the extension part 122. Until the fixing structure 110 is sustained against the stopping part 123, the plug 15 is positioned in a fixed location. Meanwhile, the pins 111 of the coupling member 11 are contacted with adjacent conducting pieces 143 of the base 14. That is, the orientation of the plug 15 is changeable by rotating the main body 10 of the electronic device 1 or rotating the plug 15.

In an embodiment, the plug 15 is positioned in a fixed location relative to the main body 10 of the electronic device 1 by rotating the plug 15 in a single direction. In addition, when the user wants to detach the plug 15 from the main body 10 of the electronic device 1, the plug 15 can be rotated to an unlocked location relative to the main body 10. Meanwhile, the pins 111 of the coupling member 11 are separated with the conducting pieces 143 of the base 14, and the fixing structure 110 of the main body 10 is corresponding to the opening 120 of the plug 15 so that the plug 15 can be detached from the main body 10 of the electronic device 1 by an external force.

Figure 5:
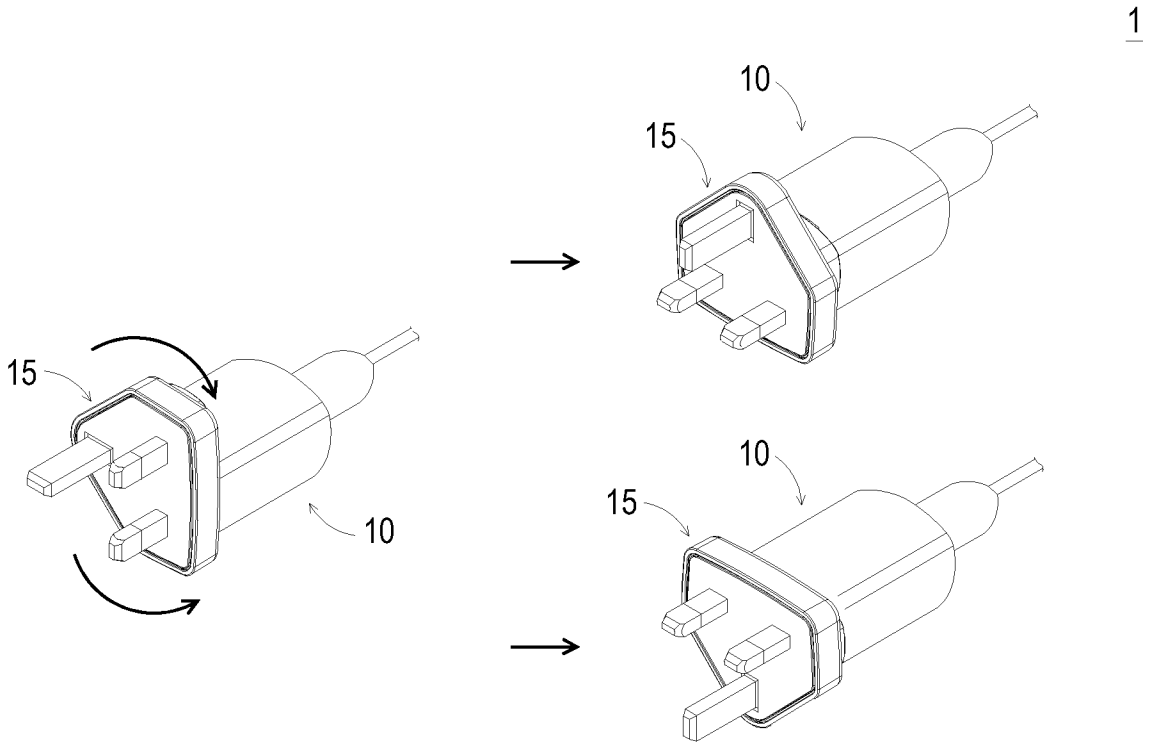
FIG. 5 schematically illustrates a way of changing the orientation of the plug according to another embodiment of the present invention.

FIG. 5 schematically illustrates a way of changing the orientation of the plug according to another embodiment of the present invention. As shown in FIG. 5, the main body 10 of the electronic device 1 and the plug 15 are combined together. After the plug 15 is rotated in a clockwise direction by 90 degrees or the plug 15 is rotated in an anti-clockwise direction by 90 degrees, the orientation of the plug 15 is changed, and the main body 10 and the plug 15 are electrically connected with each other. Since the plug 15 is rotatable, the space restriction of the power socket will be minimized. That is, the flexibility of using the plug is enhanced.

It is noted that, however, those skilled in the art will readily observe that numerous modifications and alterations may be made while retaining the teachings of the invention. For example, the positioning ring 13 may be modified to position the plug 15 in different locations by rotating different angles (e.g. 30 degrees, 60 degrees, . . . , or 360 degrees). Moreover, the plug 15 is a detachable plug. That is, the plug 15 is detachably connected with the main body 10. According to the power regulations of different countries, the plug 15 may be varied. For example, the number of the conducting terminals 141 of the base 14 may be changed from three to two.

Figure 6:
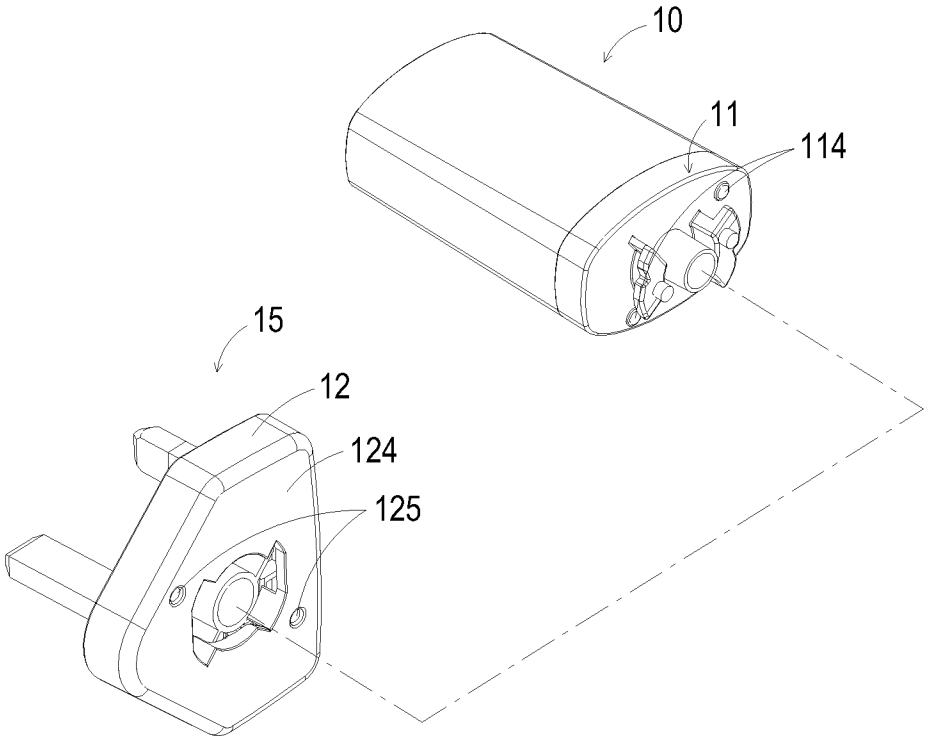
FIG. 6 is a schematic view illustrating an electronic device with a rotatable plug according to another embodiment of the present invention.

FIG. 6 is a schematic view illustrating an electronic device with a rotatable plug according to another embodiment of the present invention. In this embodiment, the coupling member 11 of the main body 10 has at least one first engaging element 114, and the casing 12 of the plug 15 has at least one second engaging element 125 formed on an outer surface 124 of the casing 12. The second engaging element 125 can be engaged with a corresponding first engaging element 114. In an embodiment, the first engaging element 114 and the second engaging element 125 are protrusion and concavity, respectively. When the plug 15 is rotated to the fixed location relative to the main body 10, the first engaging element 114 is engaged with the second engaging element 125 for fastening the plug 15 with the main body 10 securely.

From the above description, the electronic device of the present invention has a rotatable plug. Due to the arc-shaped extension part of the casing, the elastic positioning ring and the fixing structure of the main body, the main body and the plug may be combined together in a foolproof manner. Consequently, the problem of erroneously assembling the plug will be eliminated. Moreover, upon rotation of the fixing structure, the fixing structure is moved along the extension part and the positioning ring is propped open by the fixing structure. Until the fixing structure is rotated to a fixed location, the pins of the coupling member are contacted with the conducting pieces of the base of the plug to transmit electricity. Since the plug is rotatable, the space utilization of inserting the plug in the power socket will be enhanced. Moreover, since the positioning ring is made of an elastic plastic material, the locking force of the positioning ring is not reduced with a long use time. In other words, the use life of the plug is prolonged. Moreover, the plug is a detachable plug. According to the power regulations of different countries, the plug may be varied, so that the flexibility of using and storing the electronic device is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device, comprising:

a plug comprising a casing, a base and a positioning ring, wherein said casing has an opening and an extension part formed on an inner surface thereof, said base comprises at least two conducting pieces, and said positioning ring is sheathed around an outer periphery of said extension part; and a main body comprising a coupling member, wherein said coupling member has a fixing structure and at least two pins, wherein after said fixing structure is penetrated through said opening, said fixing structure is rotated to be moved along said extension part to a fixed location, so that said plug and said main body are combined together and said at least two pins are respectively contacted with said at least two conducting pieces.

2. The electronic device according to claim 1, wherein said casing further comprises a stopping part, which is arranged at an end of said extension part, wherein when said fixing structure is rotated to be moved along said extension part to said fixed location, said fixing structure is sustained against said stopping part, so that rotation of said fixing structure is stopped.

3. The electronic device according to claim 1, wherein said extension part is arc-shaped, and said extension part has a gradual slope for guiding said fixing structure to be moved along said extension part.

4. The electronic device according to claim 1, wherein said positioning ring is made of an elastic plastic material.

5. The electronic device according to claim 1, wherein a profile of said fixing structure mates with a profile of a corresponding inner periphery of said opening so that said fixing structure is penetrable through said opening in a foolproof manner.

6. The electronic device according to claim 1, wherein said plug is detachably connected with said main body.

7. The electronic device according to claim 1, wherein said electronic device is one of a power converter, a power adapter and a charger.

8. The electronic device according to claim 1, wherein said base has a hollow cylindrical structure formed on an inner surface thereof, and said coupling member has a central post corresponding to said hollow cylindrical structure.

9. The electronic device according to claim 1, wherein said coupling member has at least one first engaging element, and said casing has at least one second engaging element formed on an outer surface thereof, and wherein when said plug is rotated to said fixed location relative to said main body, said first engaging element is engaged with said second engaging element.

10. The electronic device according to claim 1, wherein said positioning ring has at least one positioning point.

11. The electronic device according to claim 10, wherein said fixing structure further comprises at least one hooking part corresponding to said at least one positioning point of said positioning ring, wherein after said fixing structure is penetrated through said opening and said positioning ring is sheathed around said extension part, said hooking part and said positioning point are engaged with each other, wherein upon rotation of said fixing structure, said positioning ring is propped open and deformed by said fixing structure, thereby permitting smooth rotation of said fixing structure, wherein when said fixing structure is rotated to said fixed location, said positioning point is sustained against an end of said fixing structure for facilitating positioning said fixing structure.

12. A rotatable plug of an electronic device, said electronic device comprising a main body, said main body comprising a coupling member with a fixing structure and at least two pins, said rotatable plug comprising:

a casing having an opening and a stopping part, wherein an extension part is formed on an inner surface of said casing, and said stopping part is arranged at an end of said extension part;

a positioning ring sheathed around an outer periphery of said extension part; and a base comprising at least two conducting pieces, wherein after said fixing structure is penetrated through said opening, said fixing structure is rotated to be moved along said extension part to a fixed location, said fixing structure is sustained against said stopping part, so that rotation of said fixing structure is stopped, and said plug and said main body are combined together and said at least two pins are respectively contacted with said at least two conducting pieces.

13. The rotatable plug according to claim 12, wherein said extension part is arc-shaped, and said extension part has a gradual slope for guiding said fixing structure to be moved along said extension part.

14. The rotatable plug according to claim 12, wherein said positioning ring is made of an elastic plastic material.

* * * * *